US005884335A

United States Patent [19]

Whittaker

[11] Patent Number: 5,884,335

[45] Date of Patent: Mar. 23, 1999

[54] SHAPE RETAINER FOR USE IN A BASEBALL CAP

[76] Inventor: Byron J. Whittaker, 3107 S. Linwood Dr., Sand Springs, Okla. 74063-4131

[21] Appl. No.: 886,182

[22] Filed: Jul. 10, 1997

Related U.S. Application Data

[62] Division of Ser. No. 674,403, Jul. 2, 1996, Pat. No. 5,647,064.

[51] Int. Cl.[6] ..... A42C 5/00

[52] U.S. Cl. ..... 2/195.5; 2/181.4; 223/84

[58] Field of Search ..... 2/171.1, 175.4, 2/181, 181.2, 181.4, 181.6, 182.8, 195.5, 209.13, 416; 223/24, 66, 84

[56] References Cited

U.S. PATENT DOCUMENTS 4,035,847 7/1977 Prince et al. ..... 2/416

5,647,064 7/1997 Whittaker ..... 2/195.5

*Primary Examiner*—Diana L. Biefeld

*Attorney, Agent, or Firm*—Fellers, Snider, Blankenship, Bailey & Tippens, P.C.

[57] ABSTRACT

A baseball cap having an internal shape retainer and support assembly affixed to the interior of the crown portion of the cap. The shape retainer and support assembly comprises a flexible body having a spine and several prongs or arms projecting outwardly from the spine. The arms are flexed and positioned between the inner surface of the crown and the sweatband or liner of the cap. The button of the cap is used to secure the shape retainer in place. The flexible nature of the shape retainer counteracts the tendency of the cap crown to droop or sag and helps to maintain the original shape of the cap. In addition, fasteners can be installed on the spine of the shape retainer so that small items can be attached thereto for carrying in the space between the cap and the head.

4 Claims, 2 Drawing Sheets

SHAPE RETAINER FOR USE IN A BASEBALL CAP

This application is a divisional of application Ser. No. 08/674,403, filed on Jul. 2, 1996, now U.S. Pat. No. 5,647,064.

BACKGROUND OF THE INVENTION

1. Technical Field

The present invention relates generally to headwear, and, more specifically, to baseball caps having an interior shape retainer and support assembly.

2. Background

It is probably safe to say that headwear in general, especially men's headwear, is not as popular as it once was. The exception is the baseball cap, which has become ubiquitous. Besides its use in the game of baseball, the baseball cap is commonly worn during all types of recreational activities and, apart from these activities, as a standard article of clothing.

Over time wear and tear affects the baseball cap, manifested in the sagging or drooping of portions of the cap. This occurs more frequently when the cap is worn during strenuous activities that cause sweating. When the fabric of the cap is repeatedly moistened and dried, the fabric may contract, crumple or otherwise take on an irregular shape. This also occurs when a soiled cap is purposefully washed.

Persons who wear baseball caps, particularly when participating in recreational activities, may desire to use the cap to hold or store small items. They may not have pockets in their clothing or they may prefer not to store items in their pockets for one reason or another.

It is thus an object of the present invention to prevent the sagging and drooping of caps by providing an interior shape retainer to help maintain the original contour of the cap.

It is a related object that the shape retainer be easily adaptable for use as a permanent component of a baseball cap or as an insert for installation on an as needed basis.

It is a further object of this invention that the shape retainer also function as a support assembly so that small items can be stored inside the cap during its use.

SUMMARY OF THE INVENTION

The present invention comprises a baseball cap having an internal shape retainer and support assembly affixed to the interior of the crown portion of the cap. More specifically, the shape retainer and support assembly comprises a flexible body having a spine and several prongs or arms projecting outwardly from the spine. The arms are flexed and positioned between the inner surface of the crown and the sweatband or liner of the cap. The button of the cap is used to secure the shape retainer in place. If desired, the arms of the shape retainer are also sewn into place. The shape retainer acts as a frame or skeleton to counteract the tendency of the cap crown to droop or sag and helps to maintain the original shape of the cap. In addition, fasteners can be installed on the spine of the shape retainer so that small items can be attached thereto for carrying in the space between the cap and the head.

In the most preferred embodiment, the shape retainer and support assembly has six arms. When installed in the crown portion of a typical cap, the arms lie against the interior surface of a bias binding sewn over several seams that join the plurality of wedge shaped panels which make up the crown portion. As such the shape retainer is inconspicuous.

A small piece of VELCRO is adhesively attached to the spine of the shape retainer to mate with a complementary piece that may be affixed, for example, on an elastic band for holding small articles. The shape retainer is a unitary device made of a tough, yet flexible, plastic. It is cut or stamped in its preferred form from a sheet of plastic material.

A better understanding of the invention and its objects and advantages will become apparent to those skilled in this art from the following detailed description, taken in conjunction with the attached drawings, wherein there is shown and described only the preferred embodiment of the invention, simply by way of illustration of the best mode contemplated for carrying out the invention. As will be realized, the invention is capable of modifications in various obvious respects, all without departing from the invention. Accordingly, the description should be regarded as illustrative in nature and not as restrictive.

DETAILED DESCRIPTION OF THE PREFERRED EMBODIMENT

Figure 1:
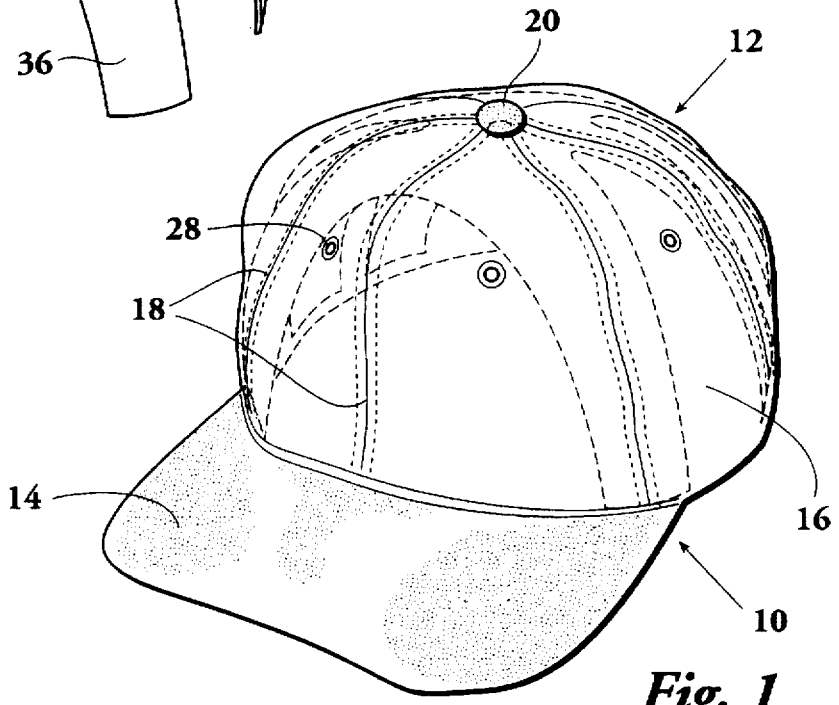
FIG. 1 is a perspective view showing a typical baseball cap incorporating the present invention.
Figure 2:
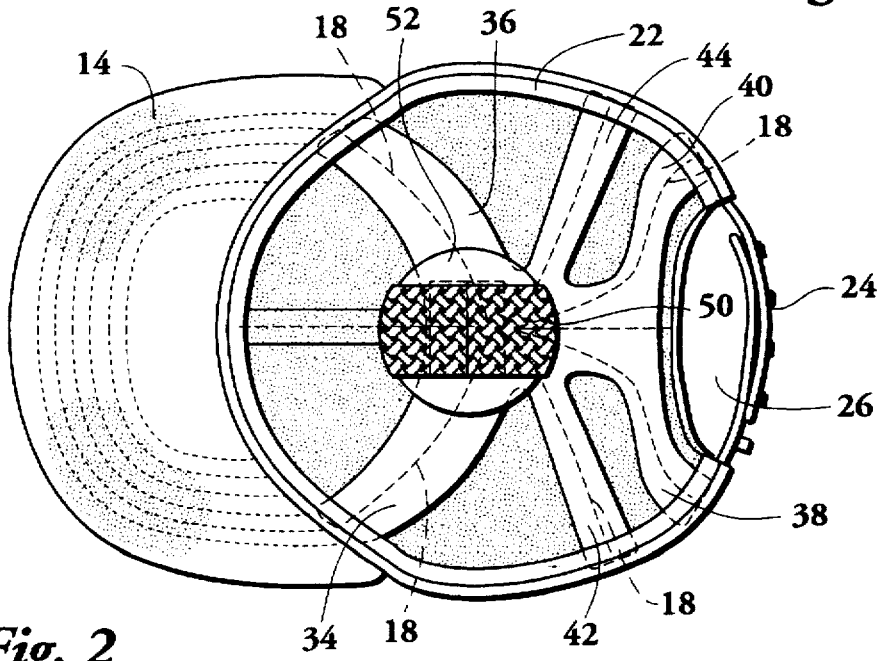
FIG. 2 is a bottom view of the baseball cap of FIG. 1.
Figure 5:
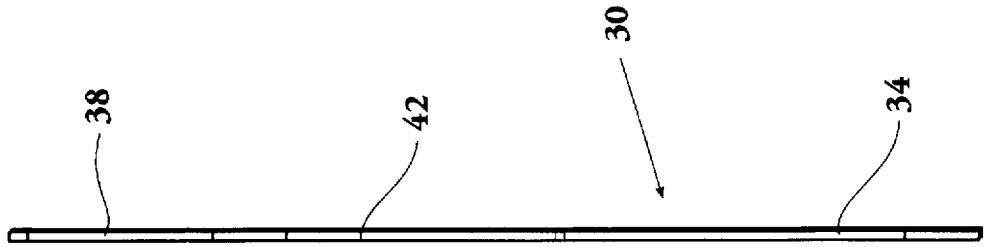
FIG. 5 is a side view of the preferred shape retainer illustrated in FIG. 3.

The present invention is designed for use with a standard baseball-type cap, such as is illustrated in FIGS. 1–2. The cap, generally indicated by the reference numeral 10, consists of a crown portion 12 and a crescent shaped bill 14. The crown portion 12 is commonly constructed from a plurality of wedge shaped panels or gores 16 sewn together at a number of seams 18 and converging at the top most part of the crown portion 12 at a button 20. In some caps, side and rear panels may be constructed of a mesh material. An interior bias binding (not shown) is usually sewn over the seams 18 joining the panels 16. A sweatband 22 is sewn around the interior of the crown portion 12 at the bottom edge of the panels 16. If the cap 10 is of the type that has an adjustable snap tab 24, the two most rearward panels 16 are typically partially cutaway to provide a semicircular opening 26 at the lower back part of the cap 10. A number of eyelets 28 are spaced about the crown portion 12 of the cap 10.

Figure 4:
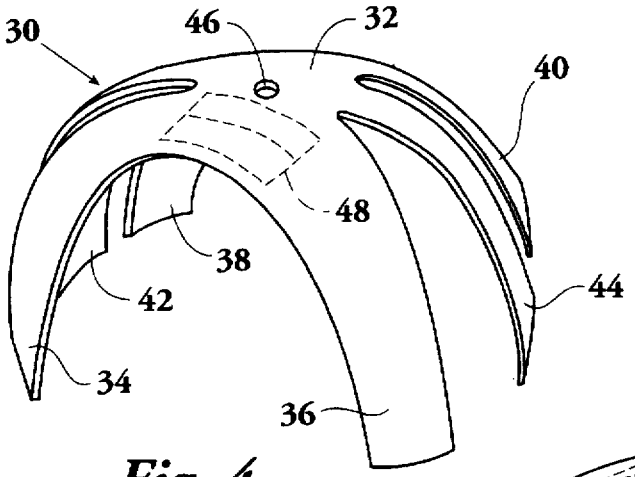
FIG. 4 is a perspective view showing the preferred shape retainer and support assembly in its cap supporting position.
Figure 3:
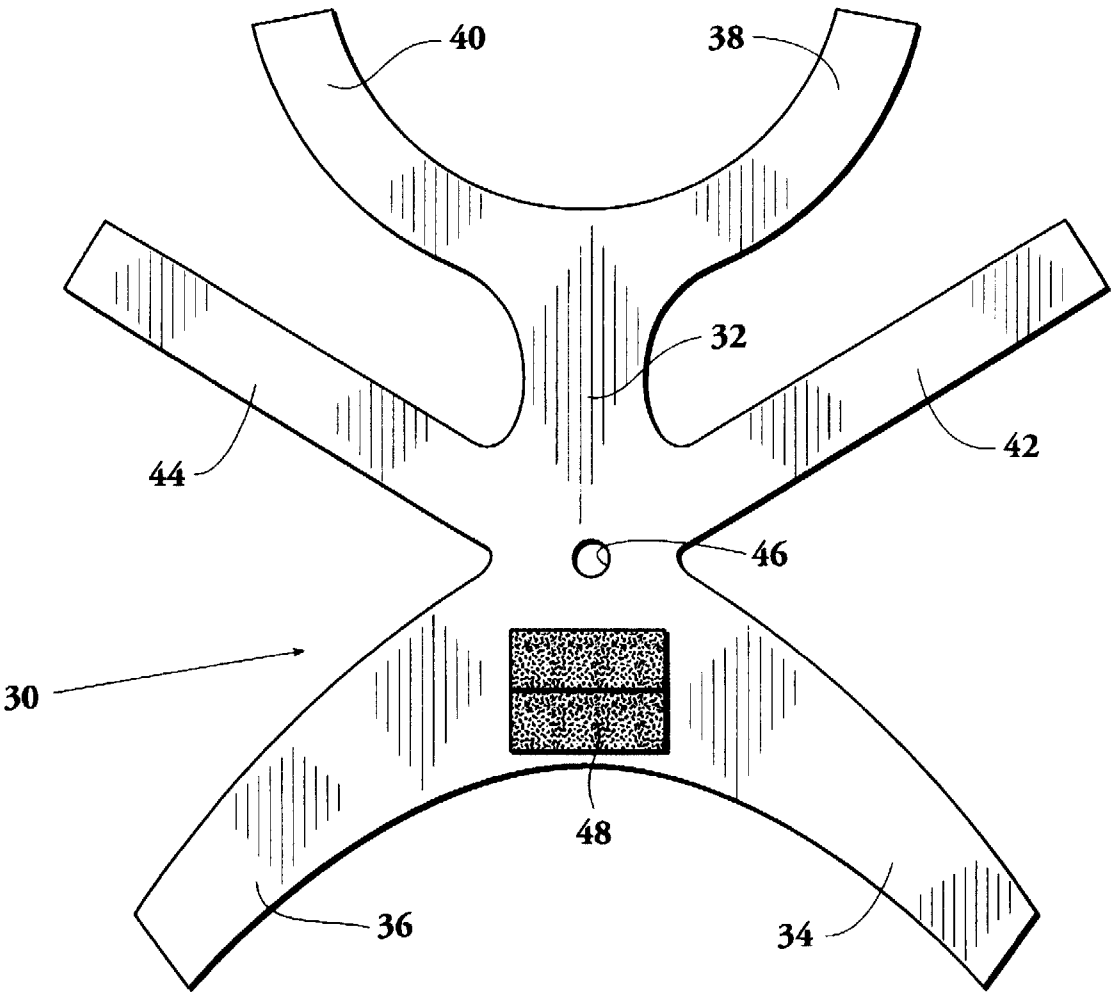
FIG. 3 is a plan view showing the preferred shape retainer and support assembly laid flat.

Turning for a moment to FIGS. 3–4, the preferred shape retainer and support assembly 30 is described. The shape retainer 30 is made of a thin, preferably 0.030–0.060 inch, unitary piece of flexible material, such as an appropriate plastic. Polystyrene is preferred.

The shape retainer 30 has a spine or central section 32 from which a number of arms outwardly extend. A forward pair of arcuate arms 34, 36 are integrally formed to a top portion of the spine 32 creating a crescent shaped structure. Similarly, a rearward pair of arcuate arms 38, 40 are integrally formed to a lower portion of the spine 32. The rearward pair of arms 38, 40 are smaller in width than the forward pair of arms 34, 36. A pair of opposing intermediate arms 42, 44 project outwardly from the spine 32 and downwardly toward the rearward pair of arms 38, 40 at a slight angle. A small hole 46 is provided so that the button of the cap can be used to permanently affixed the shape retainer 30 to the interior of the cap. Strips of VELCRO 48 are adhesively applied to the inner surface of the spine 32 of the shape retainer 30 to provide an attachment surface for holding small items, as is described in further detail hereunder.

Not limiting the scope of the invention in any way, the most preferred dimensions of the shape retainer 30 are as follows. As measured along its longitudinal axis, the spine 32 or central portion of the shape retainer 30, including the forward and rearward portions of the spine 32 integrally formed and conjoined with the forward and rearward arms 34–40, is about 6.5 inches long. The distance between the inner tips of the forward pair of arms 34, 36 is about 9.5 inches. At their widest point, i.e. where they merge with the spine 32, each of the forward pair of arms 34, 36 is approximately 2.5 inches wide. At their tip, they are about 1.1 inches wide. Each of the rearward arms 38, 40 and the intermediate arms 42, 44 is of a uniform width of about 1 inch. The distance between the inner tips of the rearward pair of arms 38, 40 is about 6 inches. The long edge of each of the intermediate arms 38, 40 is about 6 inches in length, while the shorter edge is about 5.5 inches. The width of the spine 32 at the point where the forward pair of arms 34, 36 and intermediate pair of arms 42, 44 converge is approximately 2.2 inches. The width of the spine 32 at its most narrow point, i.e. between the intermediate pair of arms 42, 44 and the rearward pair of arms 38, 40, is about 1.4 inches. The shape retainer 30 is of a uniform thickness of approximately 0.030 inch.

As shown in FIGS. 1–2 and 4, when in use the shape retainer 30 is flexed and formed into an inner frame or skeleton to support the inner surfaces of the crown portion 12 of the cap 10. The arms 34–44 are flexed and the ends of the arms 34–44 are positioned between the inner surface of the wedge shaped panels 16 and the sweatband 22. To permanently affixed the shape retainer 30 to the interior of the cap 10, the button 20 can be punched through the spine 32 of the shape retainer 30. A detachable or releasable button, such as a two element threaded button, can be utilized if desired. The ends of the arms 34–44 can also be sewn into place. When properly installed, the arms 34–44 lie against the interior surface of the seams 18 joining the panels 16, including the seams defining the semicircular opening 26 found in many caps. Thus, even in mesh type caps the shape retainer 30 is inconspicuous. To further disguise the shape retainer 30, it can be made in a color corresponding to the color of mesh used in the cap.

The shape retainer 30, though, need not be permanently affixed to be effective. The shape retainer 30 is also useful as an after-market product for temporary installation. Due to the flexible nature of the shape retainer 30, it will maintain its position in the interior of the crown portion 12 of the cap 10 without being sewn thereto or affixed by the button 20. Thus, the shape retainer 30 can be used on an as needed basis, such as immediately after the cap has been washed. At other times, the cap can be used without the shape retainer 30.

When the shape retainer 30 is used, it can also function as a support assembly for holding small items. There is ample room between the cap 10 and the head to store small items. In the preferred embodiment, a hook and loop fastener is used to hold and support small items for storage in the top of the cap 10. One or more strips of VELCRO (hook side) 48 are adhesively attached to the inside surface of the spine 32 of the shape retainer 30. A band 50 having the complementary side of the fastener attached thereto is used to hold the item 52. The band 50 is wrapped around the item 52 and pressed against the strips 48 to secure the item 52 inside the cap 10. Pulling on the band 50 releases it from the strips 48 and the item 52 can be retrieved.

Thus, there is provided a baseball cap having a shape retainer and support assembly that prevents the crown portion of the cap from drooping or falling and also functions to store small items inside the cap during its use. The shape retainer and support assembly is easily adaptable for use as a permanent component of a baseball cap, or, instead, may be used on an as needed basis as a temporary insert.

Whereas, the present invention has been described in relation to the drawings attached hereto, it should be understood that other and further modifications, apart from those shown or suggested herein, may be made within the spirit and scope of this invention.

What is claimed is:

1. A shape retainer for use in a baseball cap, comprising a flexible body having a spine, a forward pair of arcuate arms integrally formed to a top portion of said spine, a rearward pair of arcuate arms integrally formed to a lower portion of said spine, and a pair of opposing intermediate arms projecting outwardly from said spine and downwardly toward said rearward pair of arms at a slight angle, said shape retainer further comprising means for supporting small items from said shape retainer, said means including a first component of a hook and loop fastener adhesively attached to said spine, an elastic band for holding said small items, and a second component of said hook and loop fastener, provided on said elastic band, said second component being attachable to said first component.

2. The shape retainer according to claim 1, wherein said flexible body is made of a unitary piece of plastic.

3. The shape retainer according to claim 1, wherein said flexible body is about 0.030 inch in thickness.

4. A shape retainer for use in a baseball cap, comprising a flexible body having a spine, a forward pair of arcuate arms integrally formed to a top portion of said spine, a rearward pair of arcuate arms integrally formed to a lower portion of said spine, and a pair of opposing intermediate arms projecting outwardly from said spine and downwardly toward said rearward pair of arms at a slight angle, wherein said shape retainer is about 0.030 inch in thickness.

* * * * *